United States Patent [19]

Martyniak

[11] 4,420,206

[45] Dec. 13, 1983

[54] ELECTRICAL CONNECTOR

[75] Inventor: Gerald J. Martyniak, Indianapolis, Ind.

[73] Assignee: Western Electric Company, Inc., New York, N.Y.

[21] Appl. No.: 325,941

[22] Filed: Nov. 30, 1981

[51] Int. Cl.[3] ..... H01R 9/07

[52] U.S. Cl. ..... 339/75 M; 339/17 F; 339/176 MF

[58] Field of Search ..... 339/17 F, 74 R, 75 M, 339/75 MP, 176 MF, 274

[56] References Cited

U.S. PATENT DOCUMENTS

| | | | |
|---|---|---|---|
| Re. 27,463 | 8/1972 | Sitzler et al. | 339/59 R |
| 2,952,002 | 9/1960 | Angele et al. | 339/75 MP |
| 3,579,283 | 5/1971 | Welburn | 339/274 |
| 3,636,499 | 1/1972 | Winklebleck | 339/75 MP |
| 3,648,221 | 3/1972 | Tillmann et al. | 339/75 M |
| 3,686,622 | 8/1972 | Bonhomme | 339/274 |
| 3,824,529 | 7/1974 | Dorrell | 339/274 |
| 3,905,670 | 9/1975 | Anhalt et al. | 339/75 MP |
| 3,999,829 | 12/1976 | Glaesel | 339/274 |
| 4,060,295 | 11/1977 | Tomkiewicz | 339/75 M |
| 4,181,386 | 1/1980 | Olsson | 339/17 F |
| 4,252,392 | 2/1981 | Whiteman, Jr. | 339/74 R |
| 4,261,631 | 4/1981 | Guilcher et al. | 339/75 MP |

FOREIGN PATENT DOCUMENTS 30639 6/1981 European Pat. Off. ..... 339/75 MP

OTHER PUBLICATIONS

IBM Bulletin, vol. 7, No. 9, Feb. 1965, 339/17 F. "Flat Cable Connector", by H. K. Hazel.

IBM Bulletin, vol. 11, No. 11, Apr. 1969, 339/75M, R. T. Evans, "Wedge-Activated Low-Insertion Force Connector".

*Primary Examiner*—Eugene F. Desmond

*Assistant Examiner*—Gary F. Paumen

*Attorney, Agent, or Firm*—R. F. Kip, Jr.

[57] ABSTRACT

The invention relates to a connector(12) adapted to be used with a plastic sheet (15) on a circuit board (13) to effect electrical connection between registering conductive areas of conductive strips 17 and 14 on the adjacent surfaces, of respectively, the sheet and the board. The connector comprises (a) a housing (20) adapted to be placed over the sheet and board and having legs (22) with means at their lower ends to couple the housing to the board (13), and (b) a pressure generating body (41) adjustable in the housing (20) between a first setting at which the body exerts no significant pressure and a second setting at which the body exerts downward pressure on the sheet resulting in a pressing together of the said registering conductive areas on the sheet and board.

17 Claims, 11 Drawing Figures

ELECTRICAL CONNECTOR

TECHNICAL FIELD

This invention relates generally to electrical connectors and, more particularly, to connectors adapted to make electrical connection between a plurality of conductive strips, contact pads, terminals or other conductive areas on a circuit board or other carrier and a plurality of conductive areas on another carrier.

BACKGROUND OF THE INVENTION

In electronic circuit technology, it is required in many applications to make electrical connection between circuit elements on one circuit board or other carrier of such elements and circuit elements on another physically separate carrier thereof. In the past, this has commonly been done by utilizing electrical connectors soldered to contact pads or other conductive areas on the one carrier and to leads extending away from such connector, and by other electrical connectors soldered to such leads and to contact pads or the like on the other carrier. Such mode of connection involves an undesirable large number of components and is undesirably expensive and time consuming to effect.

As an alternative, U.S. Pat. No. 4,261,631 issued Apr. 14, 1981 in the name of B. Guilcher discloses electrically connecting directly a plurality of contact pads on a circuit board with registering spring contacts projecting up from an underlying base portion. This is done by a connector comprising the base portion, a pair of uprights fixedly secured to longitudinally opposite ends of the base portion, a hollow vertically movable block disposed above the base portion, and a longitudinal control shaft passing through the block. In FIG. 1, the movable block's transverse cross section is in the form of a "U" lying on its side, the circuit board is inserted into a slot in the free end of the lower arm of the "U", and the opposite ends of the shaft are rotatably received in holes in the two uprights. In FIG. 4, the movable block's transverse cross section is in the form of a hollow rectangle, the circuit board is fixed to the undersurface of the movable block which is slidably movable up and down within a downwardly open fixed block fixedly mounted in relation to the mentioned base portion and uprights, and the opposite ends of the shaft are rotatably mounted in holes in longitudinally opposite ends of the fixed block. For both the FIG. 1 and the FIG. 4 embodiments, the control shaft is of a circular cross section but has longitudinally spaced therealong a plurality of cams in the form of raised segment portions extending about 90° around the shaft.

In operation, the shaft is preliminarily turned to cause one of the cams thereon to contact the upper side of the movable block and, by further turning, to raise it enough to permit the mentioned circuit board to be positioned over the mentioned base portion.

Thereafter, the shaft is turned to a position at which those cams contact the upper surface of the underside of the movable block and displace downwardly both it and the circuit board attached thereto until the contact pads on the board make pressure contact with the spring contacts projecting upward from the base portion.

As distinct from the foregoing, an electrical connector according to the invention in one of its aspects comprises a downwardly open housing adapted to be placed over superposed carriers of registering conductive areas on the carriers' adjacent faces, the housing providing means for coupling it to the lower of such carriers. The connector further comprises means comprising a pressure generating or wedging body of non-circular cross section which is disposed within such housing and is adjustable therein between first and second settings of the body, the housing providing a load-bearing backing above and for the body. At its first setting, the body is adapted, with the housing being coupled to the lower of the superposed carriers, not to produce any significant pressure on those carriers. With, however, the housing being so coupled, the body at its second setting is inserted between such backing and such carriers and is in a simultaneous force coupled relation with both productive of a loading force on such backing and of a downward pressure which is coupled to said carriers so as to result in a pressing together of, and electrical connection between, the registering conductive areas thereon.

A connector according to the invention in other of its aspects may be distinctive because of one or more other features, alone or together, which have not yet been mentioned as, for example but without restriction, that such body is floatingly positionable in the housing, that the housing has parts adapted to cooperate with the superposed carriers to insure accurate alignment thereof in the horizontal plane, etc.

DESCRIPTION OF DRAWINGS

For a better understanding of the invention, reference is made to the following description of a representative embodiment thereof, and to the accompanying drawings wherein.

Figure 1:
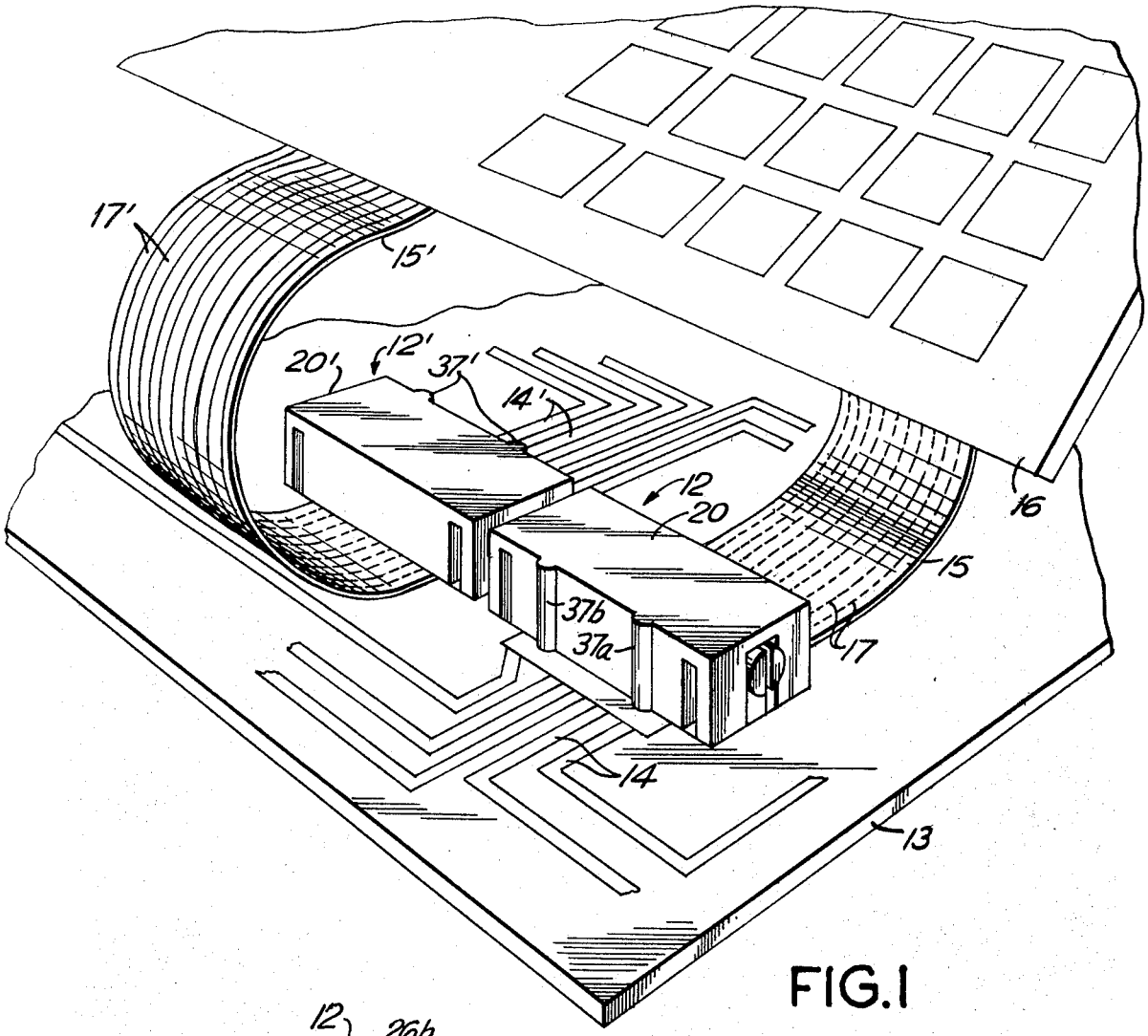
FIG. 1 is a perspective view of two connectors according to the invention, together with an assemblage of superposed carriers of registering conductive areas between which the connectors are adapted to effect electrical connection.

In the description hereinafter, a description of any element identified by a reference numeral and associated alphabetical or other suffix is to be taken, unless the context otherwise requires, as applying equally to any other element identified by the same reference numeral but by a different suffix following such numeral. Also, while the exemplary connector is, for convenience, described and claimed herein as having a particular spatial orientation, the invention of which such connector is a representative embodiment is not restricted to any particular spatial orientation of any embodiment thereof.

STRUCTURAL DETAILS

Referring now to FIG. 1, the reference numerals 12 and 12' designate two separate electrical connectors which are each exemplary embodiments of the invention. Since the two connectors are identical in construction, only the connector 12 will be described in detail.

The connector 12 is shown as being placed over an assemblage of vertically superposed carriers of registering conductive areas on the carriers' adjacent surfaces. While such an assemblage may comprise three or more of such carriers, the FIG. 1 assemblage adapted to cooperate with connector 12 consists of (a) a lower carrier in the form of a circuit board 13 having conductive elements in the form of, say, solder coated conductor strips 14 deposited on its upper surface, and (b) an upper carrier in the form of a flexible synthetic resinous sheet 15 constituting a tail of a membrane switch 16 having circuit paths thereon connected to leads on the lower surface of the tail, such leads being in the form of conductive elements constituting strips 17 of silver conductive ink, carbon graphite or solder. Those strips are deposited on the lower surface of the tail 15 and are so longitudinally spaced from each other and extend transversely in such manner that conductive areas on those strips are adapted to register with corresponding conductive areas on the strips of the circuit board 13.

Figure 2:
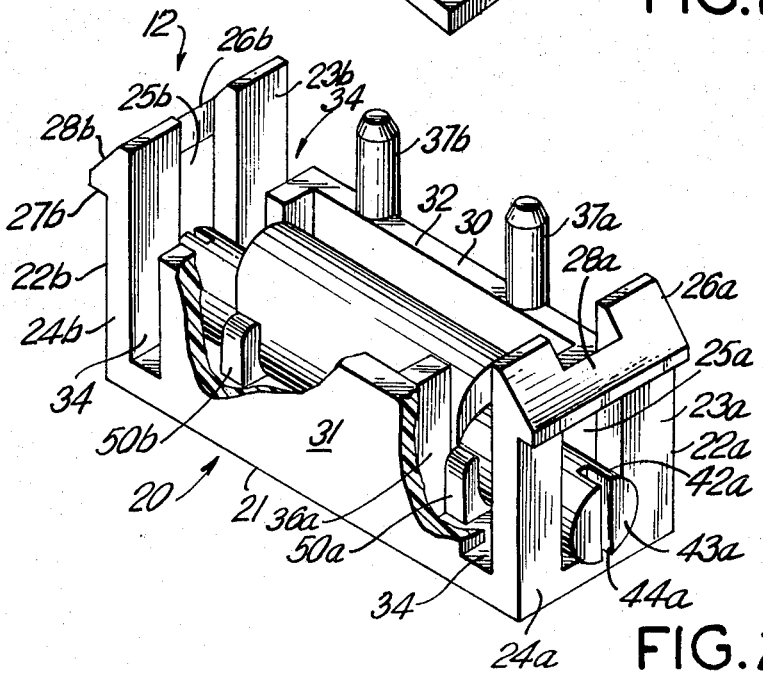
FIG. 2 is an upside down perspective view of the right-hand connector of FIG. 1.
Figure 3:
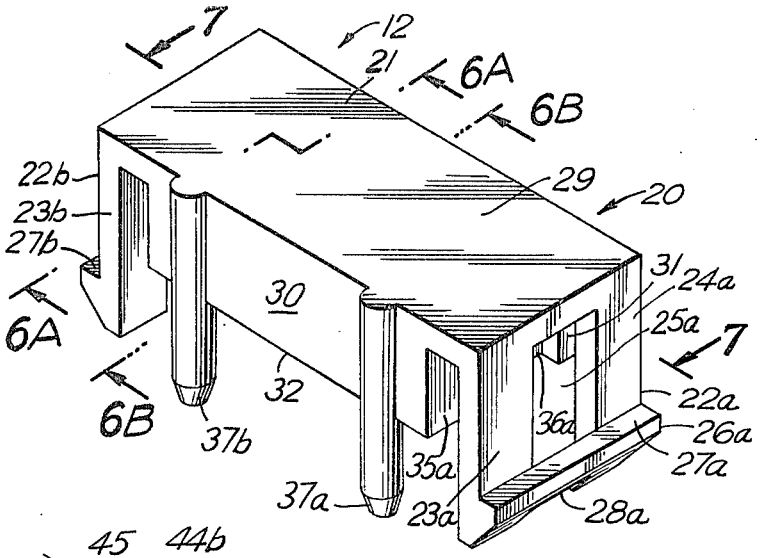
FIG. 3 is a right side up perspective view of the housing of the FIG. 2 connector.

As well seen in FIGS. 2 and 3, the connector 12 comprises a downwardly open housing 20 constituted of synthetic resinous material and having, as a part thereof, a top panel 21 integral at its longitudinally opposite ends with a pair of longitudinally spaced downwardly extending housing portions 22*a* and 22*b* with means at their lower ends for coupling the housing to circuit board 13. The portion 22*a* is in the form of a forked leg of which the lower end is resiliently deflectable longitudinally outward in relation to its upper end, and which leg consists of two tines 23*a*, 24*a* separated from each other by a vertical slot 25*a* in the leg. The tines 23*a* and 24*a* are bridged at the lower end of slot 25*a* by a longitudinally outwardly projecting shoulder 26*a* having on its upper side a flat bearing surface 27*a* and having between its top and bottom an outwardly facing wedging surface 28*a* which, downwardly, is inclined inwardly. The leg 22*b* is constructed similarly to leg 22*a*. The shoulders 26 of legs 22 are, as will be later explained in more detail, the mentioned means by which housing 20 may be coupled to the circuit board 13.

Figure 5A:
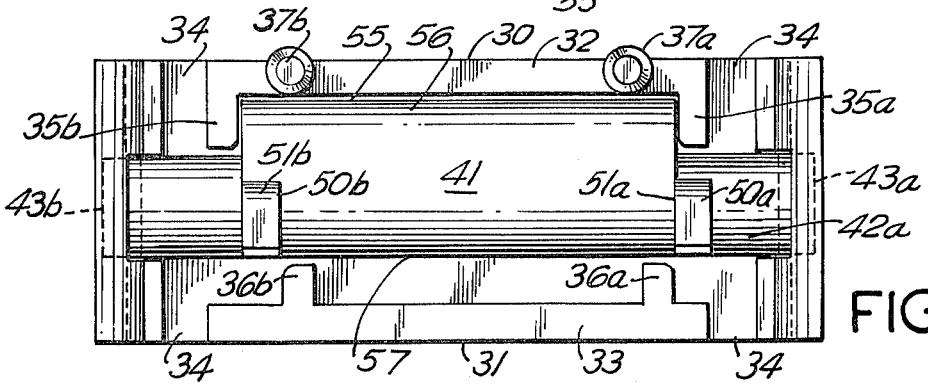
FIG. 5A is a bottom plan view of the FIG. 3 housing with the FIG. 4 pin being inserted therein (hereinafter the "FIG. 3 connector") when such pin is at a "no pressure" setting.
Figure 5B:
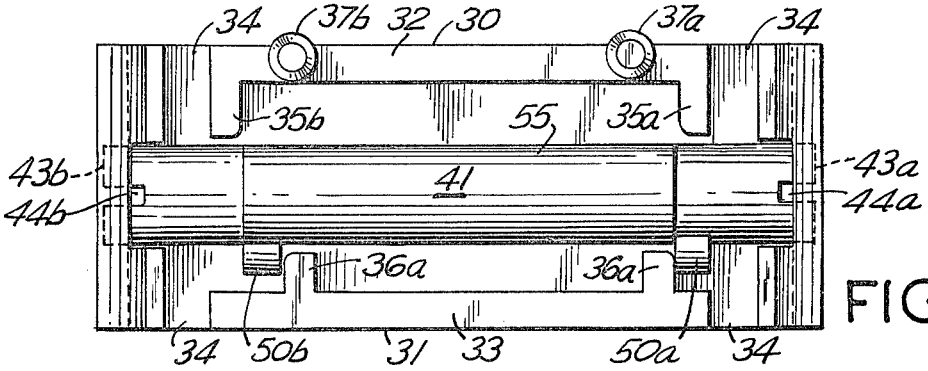
FIG. 5B is the same view as FIG. 5A except that the pin is shown when at its pressure generating setting.
Figure 6A:
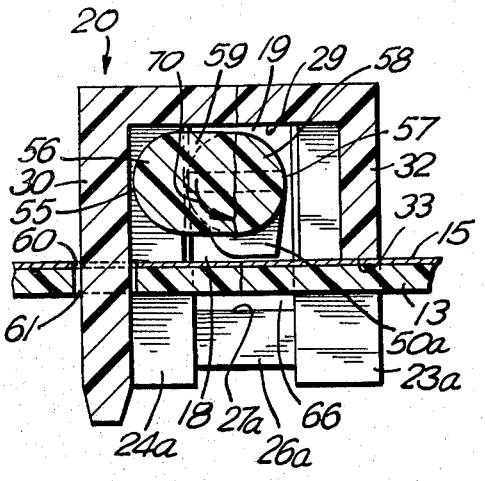
FIG. 6A is a right side elevation in zig-zag cross section; taken as indicated by the arrows 6A—6A in FIG. 3, of the FIG. 3 connector with its pin at the FIG. 5A setting, and with the connector being coupled to the FIG. 1 carrier assemblage of which portions are shown in fragmentary cross section.
Figure 6B:
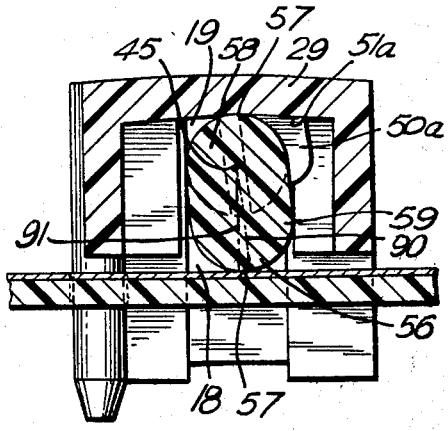
FIG. 6B is a right side elevation in a planar cross section, taken as indicated by the arrows 6B—6B in FIG. 3, of the FIG. 3 connector with its pin at the FIG. 5B setting, FIG. 6B otherwise being the same view as FIG. 6A.
Figure 7:
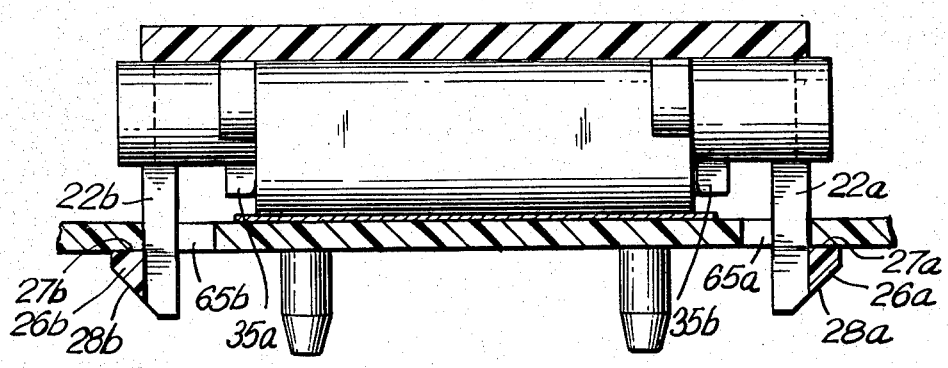
FIG. 7 is a rear elevation in cross section, taken as indicated by the arrows 7—7 in FIG. 3 of the FIG. 3 connector with its pin being at its pressure generating setting.

The top panel 21 has joined thereto on transversely opposite sides thereof a front wall 30 and a back wall 31 both of which are integral with the panel and extend downwardly therefrom by the same distance such that the bottom surfaces 32 and 33 of the walls 30 and 31 are definitive of a bottom opening 18 for the interior 19 of the housing (see FIGS. 6A and 6B). Between the upper ends of walls 30 and 31, panel 21 provides a web portion 29 forming a closure for the top of the housing's interior 19. The longitudinally opposite sides of walls 30 and 31 terminate short of legs 22 to be separated therefrom by gaps 34 which render those legs more resiliently deflectable outward than they would be if the front and back walls and legs were to be integrally joined together. The front wall 30 has integral therewith at its longitudinally opposite ends (FIGS. 5A and 5B) a pair of transversely inwardly turned ribs 35*a* and 35*b* which stiffen that wall against transverse resilient deflection. The back wall 31 has integral therewith a pair of inwardly turned ribs 36*a*, 36*b* which perform a similar function and similarly project transversely inward from the inside of the wall, but which are longitudinally displaced inwards from the longitudinally opposite ends of wall 31. The ribs 35 and 36 not only stiffen the mentioned walls but also are definitive of vertical guideways within housing 20 as later explained.

The front wall 30 of housing 20 has integral therewith a pair of longitudinally spaced vertical registration pins 37*a*, 37*b* which extend downwardly beyond the bottom surface 32 of that front wall. The function of such pins will be later explained.

Connector 12 also includes a pressure generating means comprising a pin 40 (FIG. 4) constituted of a longitudinally central section in the form of a pressure generating or wedging body 41 and, also a pair of circular cylindrical stems 42*a*, 42*b* projecting longitudinally outward from the longitudinally opposite ends of body 41. Each of such stems has a cross section of smaller size than the cross section of body 41. The stems 42*a*, 42*b* have respective end faces 43*a*, 43*b* in which are formed respective screw driver slots 44*a*, 44*b*. When within housing 20, pin 40 is angularly adjustable about an axis 45 which longitudinally passes therethrough, but which does not necessarily remain fixed in location in relation to the cross section of the pin.

Figure 4:
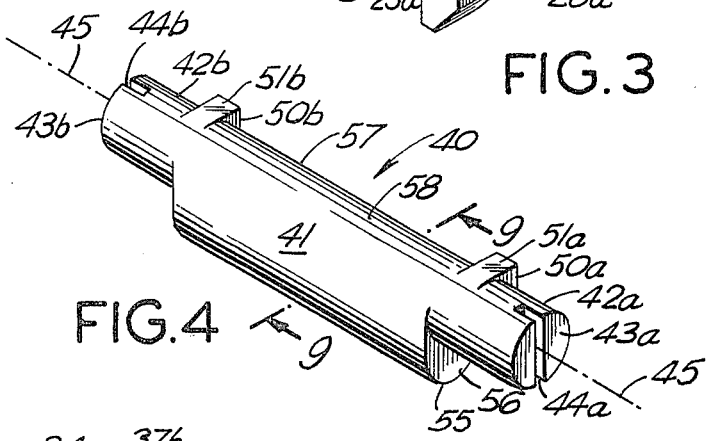
FIG. 4 is a right side up perspective view of the pressure generating pin of the FIG. 2 connector.

Pin 40 has formed thereon stop means comprising a pair of lugs 50*a*, 50*b* which project in the vertical plane outward of the remainder of the pin, and which have respective surfaces 51*a*, 51*b* on top of the pin when in its FIG. 4 position and adapted, as later explained, to act as stop surfaces. The two lugs are asymmetrically located on pin 40 to the extent that lug 50*b* is formed on the central body 40 whereas lug 50*a* is formed on the stem 42*a*.

The body 41 of the pin is generally longitudinally cylindrical in shape and has a front contact face 55 on the forward part or head 56 of the body and a rear contact face 57 on the rear part 58 of the body. The cross section of body 41 normal to axis 45 is noncircular in that it has a greater dimension in one of its orthogonal coordinates normal to such axis than it does in other of such coordinates, the faces 55 and 57 of such body being separated by such greater dimension. In general, the cross section of body 41 can be considered to be made up of the rear semicircular portion 58, a central rectangular portion 59 and a front semicircular portion which constitutes the head 56.

The pin 40 is conveniently inserted in housing 20 by turning the latter upside down (FIG. 2), longitudinally spreading apart the free ends of the resiliently deflectable legs 22 of the housing until the pin can pass between them, dropping the pin into the interior 19 of the housing such that the pin's head 56 is longitudinally contained between the internal ribs 35 of the housing (FIG. 5A) and the stems 42 of the pin are aligned with the vertical slots 25 in the legs, and, thereafter, allowing the legs 22 to resiliently spring back to original position such that the pin stems 42 enter into and are contained by the slots 45. The pin 40 thus becomes caged within housing 20 so that it cannot be removed therefrom except by reversing the procedure just described. Because of the asymmetry of the location of the lugs 50 on the pin and the respective locations of the internal ribs 35, 36 of the housing, the pin 40 cannot be placed in the housing "backward", i.e., with the head 56 of body 41 facing toward the housing's rear wall 31 rather than its front wall 30, or with the left-hand end being placed in the right-hand end of the housing. When the pin is so positioned within housing 20, the ribs 35*a*, 36*a* and the ribs 35*b*, 36*b* are definitive of vertical guideways for the pin in addition to the guideways therefor provided by the vertical slots 25 in the legs 22.

The pin as received in the housing is rotatable about pin axis 45 such that the pin is angularly adjustable between a first angular setting depicted in FIGS. 5A and 6A and a second angular setting depicted in FIGS. 5B and 6B. In addition to such angular movement of the pin, the mentioned guideways therefor permit translational movement of the pin 40 and its body 41 within, and in relation to, the housing. The pin 40 and its body 41 are floatingly positionable at least up and down in housing 20 in that, at least in the vertical direction, they are, to an extent and in response to force thereon, self-adjusting in position in, and in relation to, the housing without significant structural constraint being placed on such adjustment within such extent.

When the body 41 is at its first setting (FIG. 5A), the ribs 35 of the housing cooperate with the head 56 of the body to prevent longitudinal movement of pin 40 within housing 20 in excess of the clearance between those ribs and that head. After the housing 20 has been adjusted to its second setting (FIG. 5B), the ribs 36 of the housing cooperate with the longitudinally inward respective sides of the lugs 50 to prevent longitudinal movement of the pin in the housing in excess of such clearance. Midway between those two settings, longitudinal movement of the pin in the housing is prevented (except for clearance play) both by cooperation of the ribs 35 with the head 56 and of the ribs 36 with the lugs 50.

The pin 40 is of sufficient longitudinal extent in relation to the housing that the end faces 43 of the pin project outwardly from the housings' legs 22. The amount of such projection is, however, slight, and the slots 44 in such end faces are deep enough for the bottoms of such slots to be disposed within the vertical slots 25 formed in the legs 22. As a result, when a screw driver tip is inserted into, say, the slot 44*a* and is thereafter turned to exert torque on the pin's stem 42*a* for the purpose of adjusting the setting pin body 41, the material of such stem will receive transverse support from the sidewalls bounding slot 25*a* of the tines 23*a*, 24*a* of leg 22. By virtue of such support, the torque exerted by the screw driver tip on the material of stem 42*a* will not tend to break that material away from the stem.

Evidently, pin 40 and its body 41 can be adjusted in setting by a screw driver tip inserted into, and turned in, either one of the slots 44*a* and 44*b* at the opposite ends of the pin.

OPERATION AND USE

The operation and use of the described connector can best be understood from a consideration of FIGS. 1, 6A, 6B and 7. Referring first to FIG. 1, the membrane switch tail 15 is, as a preliminary step, placed on top of the circuit board 13 to rest thereon. Tail 15 is then shifted in the horizontal plane in relation to board 13 until there is rough registration of the conductive strips 17 on the lower surface of the tail with the conductive strips 14 on the upper surface of the board and, until further, there is approximate vertical registration of a pair of holes 60 through tail 15 with a pair of holes 61 through the board, one each of such registering holes 60 and 61 being shown in FIG. 6A.

The holes 60 and 61 have locations on, respectively, the tail 15 and board 13 which are referenced to the locations on those carriers of the conductive strips provided respectively thereon, and the longitudinal spacing between the holes 60 and between the holes 61 is the same as the longitudinal spacing between the registration pins 37 of the connector 12.

Next, with the pin 40 of the connector being at its first setting (FIG. 6A), the connector 12 is placed above the carriers 13 and 15 such that the pins 37 of the connector are vertically aligned with the passages through the superposed holes 60 and 61. The connector is then lowered toward the assemblage of carriers to move the pins through such passages. Holes 60 and 61 are of such diameter as to have a close fit with the pins 37. Accordingly, the movement of the pins through the mentioned holes causes each superposed two of the holes 60 and 61 to line up accurately with each other, and such forced alignment of the holes in turn causes a highly accurate alignment to occur in both dimensions of the horizontal plane between the conductive strips 17 on the tail 15 and the conductive strips 14 on the circuit board 13. When in such alignment, the overlying conductive strips 17 register with, and are in loose contact with the underlying strips 14. Further, the insertion of the pins 37 into the holes 60, 61 serves to reference the location of connector 12 to the locations on carriers 13 and 15 of the conductive areas to be electrically connected together.

The described lowering of connector 12 not only moves its pins 37 though the mentioned aligning holes in the carriers but also serves to couple the connector to the lower carrier, i.e., board 13. Specifically, when the connector is being so lowered, its housing legs 22*a*, 22*b* (FIG. 7) are vertically aligned with a pair of corresponding vertical slot apertures 65*a*, 65*b* formed in the circuit board 13. As the lowering proceeds, the wedge faces 28 on the outwardly projecting shoulders 26 of the legs 22 strike the longitudinally outward edges of apertures 65 to cause the lower ends of the legs to be resiliently deflected longitudinally inward to an extent permitting such shoulders to pass through such apertures. Once such passage has been made, the legs 22 resiliently spring back to their original positions so as to place the bearing faces 27 on shoulders 26 beneath regions of the underside of board 13 which are adjacent to the apertures 65. The lowering movement of the connector towards the superposed carriers is, however, continued until it is stopped by the coming into contact with the bottom faces 32 and 33 of, respectively, the front and read walls 30 and 31 of the connector housing 20 with the upper surface of the upper carrier (or tail) 15, the contact between face 33 and that surface being shown in FIG. 6A. When such movement of the connector is so stopped, the connector is coupled through its legs 22 with the carriers 13 and 15, but such coupling is loose in that (FIG. 6A) there is a gap 66 between the bearing faces 27 on the legs and the underside of board 13, which gap permits some upward movement of the connector in relation to the carriers.

Having performed the steps described above, the connector 12 and the carriers 13, 15 are now in the condition in which, while the carriers have been accurately aligned with each other in the horizontal plane and the connector has been coupled to the carrier assemblage, the pin 40 is (FIG. 6A) at its first setting with the head 56 of the body 41 facing towards the front wall 30 of housing 20, and with body 41 exerting no pressure through its head 56 on the carriers. While FIG. 6A shows the pin as being slightly raised above carrier 15 so as to be out of contact with it, in practice it is more likely that the pin will rest on the upper carrier, but the pin will still not exert any significant pressure on the carriers, i.e., no pressure other than its own weight.

To complete the connection to be effected by connector 12, a screw driver tip is inserted into one of the end slots 44 of pin 40, and the screw driver is then turned, as indicated by arrow 70 in FIG. 6A, to angularly adjust the pin from its first setting to its second setting. In the course of such adjustment, the turning of the pin brings the front and rear contact faces 55 and 57 of pin body 41 into simultaneous force coupled relation with, respectively, the top of the interior 19 of housing 20 and the carrier assemblage 13, 15. That force coupled relation is one which here is, but which need not be, produced by direct engagement of front contact face 55 with tail 15 and rear contact face 57 with the top web portion 29 of the housing.

The initial effect of the establishment of such simultaneous force coupled relation is, with further turning of the screw driver, for the body 41, bearing on the carrier assemblage as a support, to act through the engagement of its rear contact face 57 with portion 29 of the housing to convert the angular movement of the head into translational displacement of the entire housing upwards in relation to the carrier assemblage until (FIG. 7) the bearing faces 27 on the housing's legs 22 come into contact with the underside of the circuit board 13 to stop further upward movement of the housing relative to the board, and to lock these two elements together under pressure and in fixed positional relation with each other. Very little torque on the pin from the screw driver is needed to effect such displacement. Up to that point, accordingly, the angular adjustment of the body 41 does not have any substantial wedging effect. Since, however, the dimension of the body 41 between its contact faces 55 and 57 is greater than the vertical distance between the bottom opening 18 of the housing and the undersurface of the web portion 29 which forms the top over the interior 19 of the housing, the head 56 of the body 41 will, at that point, project downwardly below such bottom opening 18. In the course of effecting such upward displacement of housing 20, the pin 40 and its body 41 will floatingly shift in their vertical positioning in and relative to the housing unless perchance the pin is initially so positioned in the housing that such shift will not automatically occur.

Once the limit of upward displacement of housing 20 has been reached, the body 41 is angularly adjusted further towards its second setting but can be so adjusted only by having the body exert a wedging action between the web portion 29 and the upper surface of carrier 15 so as to increase by such action the distance between them. Such increase of that distance can, of course be obtained only by deformation of the connector-carrier assemblage structure. Such deformation is represented in FIG. 6B as being provided by an upward resilient deflection by the body 41 of the housing's top web portion 29. In practice, however, the total deformation needed to permit movement of body 41 to its second setting may also be provided wholly by, or be contributed to from, deformation of other elements as, for example, by resilient bending of the shoulders 26, resilient stretching of the legs 22 or resilient deformation of the body 41 (see description of FIG. 8). Further, all or some of the needed deformation can be provided by resilient bending downward, under the head 56 of body 41, of the carrier assemblage itself. The deformation is, however, irrespective of how provided, preferably of such character that it does not result in vertical bowing of the head 56 of body 41 over the longitudinal extent of such head. The feature that web portion 29 provides a load-bearing backing for such head over all such extent is a factor tending to reduce or eliminate any possibility of such bowing occurring.

With the body 41 beng wedgingly inserted as described between the top of the interior 19 of housing 20 and the carrier assemblage, that body exerts on the housing's top web portion 29 an upward loading force absorbed by that portion which, as stated, accordingly serves as a load-bearing backing for the wedging body. Such upward force is, of course, transmitted via the housing legs 22 and the shoulders 26 on those legs to the lower carrier 13. The backing 29 reactively responds to that upward force to exert a downward force on body 41. Since that body is floatingly positionable for up and down movement within housing 20 and can, therefore, adjust itself in its vertical position relative to the housing, such downward force is transmitted in full through the body from its rear contact face 57 to its front contact face 55 to be applied from the latter face as downward pressure on the superposed carriers 13 and 15. To put it another way, since body 41 is floatingly positionable in housing 20, that body can floatingly adjust in its up and down position to equalize the downward force thereon from housing 20 and the upward force thereon from the carrier assemblage. To the extent the mentioned resilient deformation is provided by a part or parts of the connector, that downward pressure will be a yieldable pressure. Such downward pressure acts on the carriers 13, 15 together with the upward force thereon from the shoulders 26 of the housing 20, to press together registering conductive areas on the strips 14 and 17 on the carrier's adjacent surfaces and, in that manner, to provide a permanent solderless electrical connection of those areas.

After the head 56 of body 41 has made contact, as described with the upper surface of the tail 15, and the body is being further adjusted towards its second setting, the tangential movement of the head is in the direction away from the registration pins 37 of the housing. To have such movement in such direction puts the tail 15 under tension and prevents its bunching up on the circuit board 13.

The pin 40 reaches its second angular setting when the stop surfaces 51 on the lugs 50 of pin 40 come into contact with the top web portion 29 of housing 20 so as to prevent further angular turning of the pin in the forward direction. Such contact preferably occurs when the line 90 between the axis 45 of the pin and the region of contact between body 41 and the upper surface of tail 15 is a few degrees past the line 91 from that axis which is perpendicular to such upper surface. In this way, there will be generated a component of force which will cause those lug stop surfaces to forcibly bear against the web portion 29 and which, accordingly, will lock the pin to be stable in its second setting.

Returning now to FIG. 1, the tail 15' for the membrane switch 16 has its conductive strips 17' on the upper surface thereof as the tail leads out from the membrane switch, but the said tail is otherwise similar to the membrane switch tail 15. For the purpose of connecting the strips 17' on the tail 15' to corresponding conductive strips 14' on the circuit board 13, the front portion of tail 15' is looped over such that the front end of the tail points back towards the membrane switch rather than away from it (as does the front end of tail 15), and the strips 17' on the tail are downward facing on that portion. The mentioned front portion is then placed on board 13 such that strips 17' rest upon and are in loose contact with the registering upward facing strips 14' on the board. The connector 12' is then used to effect electrical connection between registering conductive areas on the strips 17' and 14' in the same way as connector 12 is used, as earlier described, to effect electrical connection between the strips 17 and 14. The only difference between how the two connectors are respectively used is that connector 12' is positioned with its registration pins 37' being on a side of the housing 20' which is opposite in the transverse direction on board 13 to the side of the housing 20 on which are the registration pins 37 of the connector 12.

Some of the advantages of the invention are as follows. No soldering is required to make a good electrical connection thereby, and also, no screws, crimping or staking is required to produce such connection—it being made with no more than a snap-on fit of the connector to the carriers and subsequent simple adjustment of the connector. The tails 15 and 15' cannot casually pull out from under the adjustable connector and thus break the connection. At the same time, the connector can be removed from the assembly without damage merely by turning pin 40 back to its first setting, pressing the resilient legs 22 towards each other until their shoulders 26 can pass through the apertures 65 in the board 13, and then lifting the connector away from the assemblage of carriers. The connector does not use any costly metal parts or plating and is otherwise inexpensive. Further, while the connector requires only zero insertion force, upon its adjustment, it provides a high degree of pressure for effecting the electrical connection.

MODIFICATIONS

Figure 8:
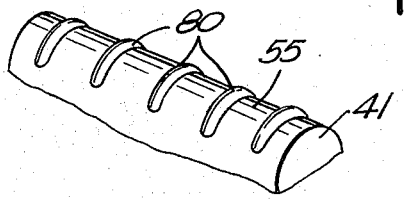
FIG. 8 is an upside down perspective fragmentary view of the FIG. 4 pressure generating pin as modified to have raised lands in accordance with an aspect of the invention.

FIG. 8 shows the pressure pin 40 as modified to have raised lands 80 on the front contact face 55 of the wedging body 41. The lands are longitudinally spaced along that front face so as to be directly over the registering conductive areas on, respectively, the tail 15 and the circuit board 13 when front face 55 exerts downward pressure on the carrier assemblage. The effect of such lands is to localize such pressure to regions beneath them of such assemblage and, thereby, for the same downward force exerted by head 41, to increase the pressure urging together those registering conductive areas as compared to what such pressure would be in the absence of those lands.

Figure 9:
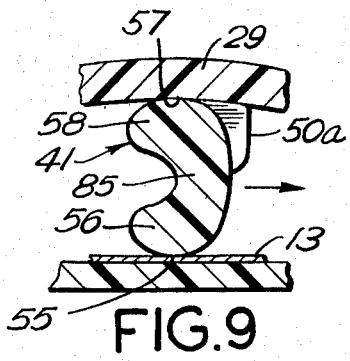
FIG. 9 is a vertical cross-sectional view, taken as indicated by the arrows 9—9 in FIG. 4, of the FIG. 4 pin as modified to have a resiliently deformable cross-sectional shape in accordance with an aspect of the invention; such modification being usable with or without the modification of FIG. 8.

FIG. 9 shows the wedging body 41 as modified in cross section to the extent that its middle rectangular portion 59 (see FIG. 6B) has been replaced by a web portion 85 which longitudinally extends for the full length of the head 41, but which is of reduced transverse dimension in relation to the head 56 and upper part 58 of the body. When body 41 is wedgingly inserted, as described above, between the top web portion 29 of the housing and the carrier assemblage 13, 15, the web portion 85 of body 41 is resiliently deformed in the direction indicated by arrow 86 to solely provide, or to contribute to, the deformation which, as earlier described, is needed to fully advance wedging body 41 to its second setting.

DETAILS OF CONSTRUCTION

The described connector may be suitably constituted of a synthetic resinous material known as acrylonitrile-butadiene-styrene, although other synthetic resinous materials may also be used. The housing and the pressure generating pin of the connector may be made by plastic molding. The connector may conveniently have a dimension of about 1-3/16 inches between the longitudinally outward extremities of its legs 22, other appropriate dimensions for the connector being obtainable by scaling from the drawings hereof on the basis of such specified dimension. The downward force exerted by the body 41 on the carrier assemblage may conveniently be in the range from about three pounds to about five pounds.

The above-described embodiments being exemplary only, additions thereto, omissions therefrom and modifications thereof may be made without departing from the spirit of the invention. Accordingly, the invention in any of its aspects is not to be considered as limited save as is consonant with the scope of the following claims.

What is claimed is:

1. A connector comprising a downwardly open housing adapted to be placed over vertically superposed carriers having registering conductive areas on the carriers' adjacent surfaces, said housing having longitudinally spaced downwardly extending portions with means at their lower ends for coupling said housing with the lower of said carriers, and pressure generating means comprising a longitudinally extending wedging body of non-circular cross section received between said portions in said housing, said body having a greater dimension in one than in the other of its cross-sectional coordinates and having, moreover, rear and front contact faces on the opposite sides of said body separated by said greater dimension, said housing providing as a part thereof a web portion forming at the top of said housing at least a partial closure over the interior thereof, and said body being adjustable in said housing between first and second settings at which, with said such housing being over said carriers and coupled with the lower one, said body is adapted to be, respectively, inoperable at said first setting to produce significant force on said carriers, and wedgingly positioned in said housing at said second setting between said web portion and carriers with said rear and front contact faces being simultaneously in a force coupled relation with, respectively, said web portion and said carriers so as to be productive by said rear face of a loading force on said web portion and by said front face of downward pressure on said carriers for pressing said registering areas together.

2. A connector according to claim 1 in which said wedging body is angularly adjustable between said first and second settings about a longitudinal axis through said body, and moreover, is movable translationally within said housing and is adapted to be translationally shifted therein in the course of angular adjustment of said body from its first to its second setting.

3. A connector according to claim 1 in which said longitudinally-spaced portions of said housing comprise downwardly-extending legs having lower ends which are resiliently deflectable and are adapted to pass through apertures in the lower of said carriers, and in which said means for coupling said housing and lower carrier comprises shoulders formed on, and projecting outward from the lower ends of said legs for bearing against the underside of such carrier.

4. A connector according to claim 1 in which said pressure generating means comprises a longitudinally-extending pin providing said wedging body as an integral part thereof, and in which opposite longitudinal ends of said pin are received in vertical guideways defined by vertical portions of said housing and adapted to constrain said pin in said housing while rendering it movable up and down therein.

5. A connector according to claim 4 in which said wedging body constitutes a central section of said pin, and said pin has stem portions at said opposite longitudinal ends thereof of smaller cross-sectional size than said body and constituting the portions of said pin received in said guideways.

6. A connector according to claim 5 in which at least one of said stem portions has an end face accessible from outside said housing and shaped to be engaged by a tool for adjusting said pin between said first and second settings.

7. A connector according to claim 4 in which said pin has stop means integral therewith, said stop means being adapted to engage with part(s) of said housing so as to stop said pin from being adjusted past said second setting.

8. A connector according to claim 7 in which stop means is adapted to cooperate with part(s) of said housing so as to stop said pin both from being adjusted past said second setting and from being misaligned in longitudinal position in relation to said housing.

9. A connector according to claim 7 in which, when said pin is so stopped, said front contact face of said wedging body is adapted to exert said downward pressure on said carriers at an angle productive of a force component for forcing together said stop means and said part(s) of said housing so as to stably maintain said wedging body at said second setting.

10. A connector according to claim 1 in which said housing includes downwardly extending parts adapted to pass through registering apertures in said vertically superposed carriers so as to produce a desired alignment therebetween in the horizontal plane.

11. A connector according to claim 10 in which said downwardly extending parts are registration pins.

12. A connector according to claim 10 or claim 11 in which said wedging body is so oriented in said housing that said front face of said body is adapted to move tangentially in a direction away from said downwardly extending parts as said body approaches its second setting 13. A connector according to claim 1 in which said front contact face has relatively raised areas thereon adapted to localize said downward pressure on said carriers to regions thereof beneath said areas.

14. A connector according to claim 1 in which said vertically superposed carriers with which said connector is adapted to be used consist of two such carriers, the lower of said two carriers is a circuit board with metallic conductive areas on the upper surface thereof, and the upper of said two carriers is a flexible synthetic resinous sheet superposed on said board and having conductive areas disposed on the lower surface of said sheet in registering relation with ones of such areas on such board.

15. An electrical connector comprising, a housing having a top portion extending over the top of the interior thereof, a bottom opening for said interior, and portions on opposite sides of said interior extending downward from said top portion to said bottom opening, said connector further comprising a longitudinally extending pressure generating body disposed in said housing below its top, said body being of noncircular cross section normal to a longitudinal axis therethrough so as to have a greater dimension in one than in the other of its cross-sectional coordinates normal to said axis, and said body being adjustable in said housing between first and second settings of said body at which, respectively, said body fits with clearance between the top of, and the bottom opening of, said housing interior, and said body contacts said top of said interior and simultaneously projects downward beyond the bottom opening of said interior.

16. A combination comprising, an assemblage of vertically superposed carriers of registering conductive areas on the carriers' adjacent surfaces, a downwardly open housing disposed over said carriers and coupled with the lower of them, and pressure generating means comprising a longitudinally extending body disposed in said housing, said body being of noncircular cross section normal to a longitudinal axis therethrough so as to have a greater dimension in one than in the other of its cross-sectional coordinates normal to said axis, and said body being angularly adjustable about said axis between first and second angular settings at which, respectively, said body is inoperable at said first setting to produce significant pressure on said carriers, and said body at said second setting is in a simultaneous force coupled relation with the top of the interior of said housing and with the upper one of said carriers so as to exert on said carriers a downward pressure under which said registering areas are pressed together.

17. The combination according to claim 16 in which said assemblage of carriers consists of two carriers, the lower of said two carriers being a circuit board with metallic conductive areas on the upper surface thereof, and the upper of said two carriers being a flexible synthetic resinous sheet superposed on said board and having metallic conductive areas disposed on the lower surface of said sheet in registering relation with ones of such areas on such board.

* * * * *